United States Patent [19]

Patun et al.

[11] Patent Number: 4,685,867

[45] Date of Patent: Aug. 11, 1987

[54] SUBMERSIBLE MOTOR-PUMP

[75] Inventors: Ronald J. Patun, Arlington Heights; Donatas Tijunelis, Buffalo Grove, both of Ill.

[73] Assignee: Borg-Warner Corporation, Chicago, Ill.

[21] Appl. No.: 945,143

[22] Filed: Sep. 22, 1978

[51] Int. Cl.[4] ..... F04B 17/00; F04B 35/00; F04B 39/06

[52] U.S. Cl. ..... 417/367; 310/54; 310/87

[58] Field of Search ..... 417/367; 165/104.26; 310/54, 87

[56] References Cited

U.S. PATENT DOCUMENTS

| | | | |
|---|---|---|---|
| 2,556,435 | 6/1957 | Moehrl et al. | 417/367 |
| 3,541,487 | 11/1970 | Leonard | 165/86 |
| 3,715,610 | 2/1973 | Brinkman | 310/54 |
| 3,765,480 | 10/1973 | Fries | 336/58 |
| 3,801,843 | 4/1974 | Cormav et al. | 310/52 |
| 4,008,579 | 2/1927 | Horvay | 165/104.26 |
| 4,045,197 | 8/1977 | Tsai | 165/104.26 |
| 4,058,160 | 11/1977 | Corman et al. | 165/104.26 |
| 4,118,646 | 10/1978 | Fleming et al. | 165/104.26 |

OTHER PUBLICATIONS

Robert B. Aronson, *Heat Pipe: Hot New Way to Save Energy,* Machine Design, 3/11/76, pp. 52–56.

J. C. Corman et al., *Thermal Design of Heat Pipe Cooled A.C. Motor,* A.S.M.E., 12/2/71.

*Primary Examiner*—Carlton R. Croyle
*Assistant Examiner*—Donald E. Stout
*Attorney, Agent, or Firm*—John W. Harbst

[57] ABSTRACT

A submersible pump-motor combination especially adaptable for use in a well casing containing well fluid and the motor filled with a lubricating fluid, and heat pipe means having a portion exposed to the motor fluid and another portion exposed to the well fluid, the heat pipe means containing a heat transfer fluid which absorbs heat from the motor fluid and discharges heat to the well fluid.

4 Claims, 3 Drawing Figures

SUBMERSIBLE MOTOR-PUMP

BACKGROUND OF THE INVENTION

The motor of a submersible motor-pump combination is usually immersed in a lubricating fluid, such as oil, which is sealed from the well fluid, for example, an oil-brine mixture in oil wells or geothermal water wells. The motor lubricating fluid generally attains a temperature in excess of that in the well, the heat being generated by the motor friction, windage and copper core losses. The generated heat is internally distributed by the motor fluid and is transferred via the motor housing to the well fluid which is at a lower temperature. This basic conduction transfer of heat to the well fluid is inefficient.

Typically, a 100 HP motor will generate about 14 KW of waste heat which must be removed to avoid motor overheating and potential motor burn-out.

In the absence of heat extracting means, motors operate in wells at temperatures up to about 100° F. above that of the well fluid. When the latter is about 150° F., motor burn-out and overheating is not a problem. However, when the well fluid is about or in excess of 300° F. the usual heat transfer by conduction through the motor housing wall may not be satisfactory to avoid motor overheating and possible early burn-out.

THE INVENTION

According to the invention herein described, a submersible pump-motor combination especially adaptable for use in a well casing which contains well fluid and with the motor filled with a lubricating fluid is provided with heat pipe means to provide additional heat transfer from the motor lubricating fluid. The ultimate life of the motor is extended by the reduction in its operating temperature. The heat pipe means has a portion exposed to the motor lubricating fluid and a portion exposed to the well fluid. Generally the heat pipe means comprises a plurality of elongated heat pipes positioned in proximity to or in contact with the motor lubricating fluid.

Each heat pipe is a sealed self-contained generally tubular unit containing a volatile fluid which acts as a refrigerant. The inside walls are constructed from a capillary to aid in fluid transfer. While heat pipes can be oriented in any direction, they are most efficient when oriented in a vertical position, as the case here. One end of each heat pipe is exposed to a heat source while the other end is exposed to a cold source.

When heat is applied to the one end of the heat pipe, the fluid therein absorbs heat and becomes vaporized. The formed vapors fill the pipe and are condensed at the other end which is in contact with a cold source. The heat pipe itself remains essentially at constant temperature throughout its length. In effect heat transfer occurs through the combination of latent heat transfer, i.e., vaporization and condensation and conduction.

In the application of this invention, the hot end of the pipe is exposed to the motor fluid and becomes heated to an elevated temperature. The volatile fluid in the heat pipe can be water or other suitable fluid, such as one of the Freons or an organic fluid Dowtherm A. The Freons can be one of the following:

| | | |
|---|---|---|
| R-112 | $CCl_2F—CCl_2F$ | Boiling point 199° F. |
| R-113 | $CCl_2F—CClF_2$ | Boiling point 117.6° F. |
| R-11 | $CCl_3F$ | Boiling point 74.9° F. |

-continued

| | | |
|---|---|---|
| R-21 | $CHCl_2F$ | Boiling point 48.1° F. |
| R-114 | $CClF_2—CClF_2$ | Boiling point 38.8° F. |

THE DRAWINGS

DETAILED DESCRIPTION

Figure 1:
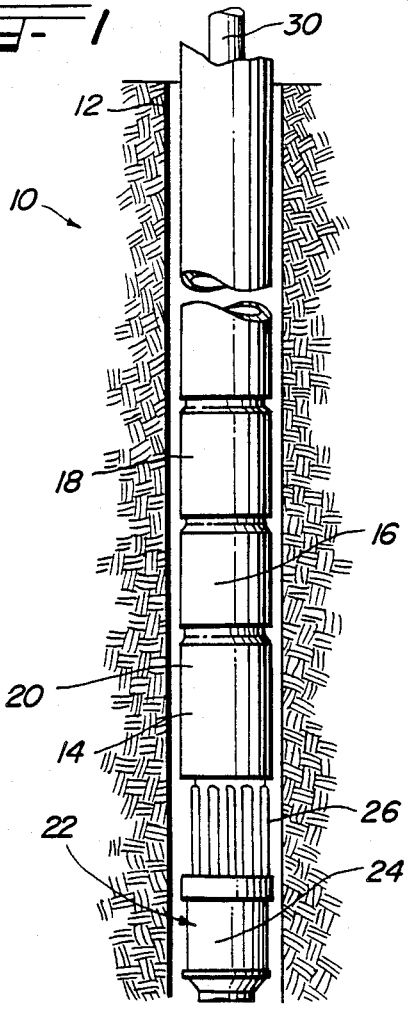
FIG. 1 is a schematic illustration of a submersible pump-motor assembly showing heat pipe means and in a well casing.

Attention is invited to the schematic illustration of a downhole or submersible pump-motor combination with heat pipe cooling means of FIG. 1 in which the combination is generally identified as 10 and comprises an elongated assembly lowered into a well casing 12. The combination 10 comprises a submersible motor 14, a seal section 16 and a pump 18. A housing 20 surrounds the winding of the motor 14. At the lower end of the motor housing 20 is a heat exchanger 22 constructed as a reservoir 24 for motor fluid and heat pipe means generally identified as 26. The motor 14 may be of multiple units; at times such motors are up to thirty feet in length. The seal section 16 performs its usual function in preventing well fluid from entering the motor. The pump 18 may be of usual construction including a plurality of alternate stages, i.e., impellers and diffusers, as known in the art.

The reservoir 24 contains motor fluid, such as oil; the motor fluid within the motor and circulating at least by convection around the motor and in the reservoir. An impeller 28 (see FIG. 2) driven by the motor 14 and connected to a motor shaft 30 may be provided and functions to provide flow of motor fluid within the motor 14 and one end of the heat pipe means 26.

Figure 2:
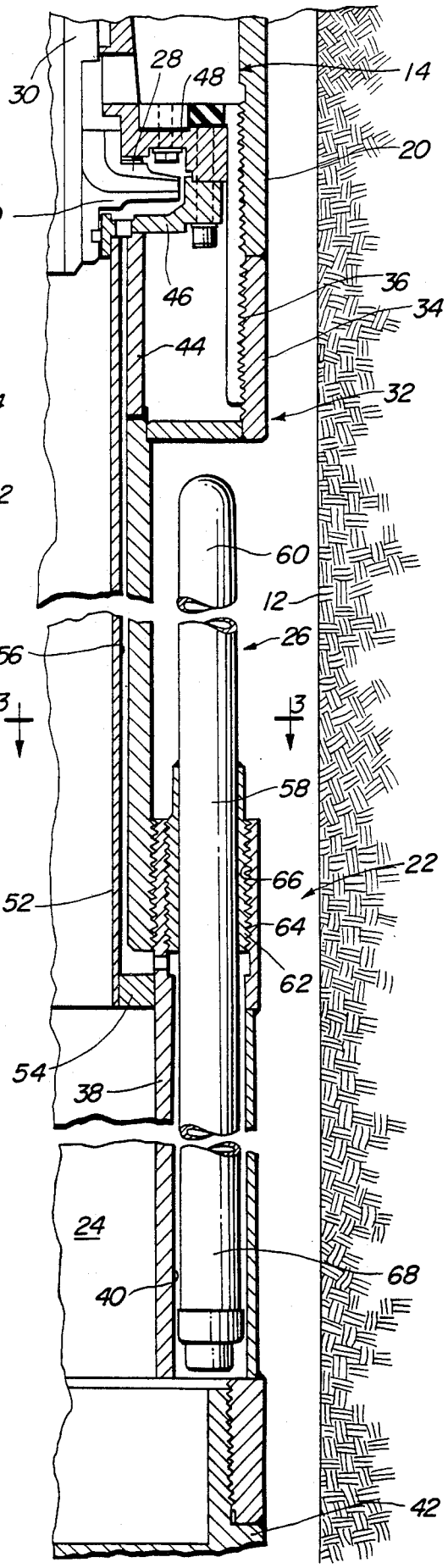
FIG. 2 is an enlarged, partial longitudinal sectional view of the heat pipe means.
Figure 3:
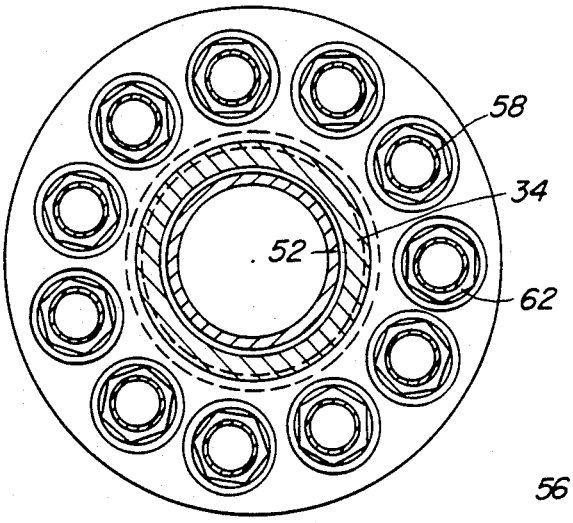
FIG. 3 is a cross-sectional view taken on line 3—3 of FIG. 2.

Attention is now invited to FIGS. 2 and 3 showing details of the heat exchanger 22 and the heat pipe means 26. The heat exchanger 22 comprises a multiple part, generally cylindrical container 32 which is connected to the motor housing 20. The container 32 has a first part 34 which is connected by a threaded joint 36 to the lower end of the motor housing 20, another part 38 threadably joined to the part 34 and having a plurality of elongated generally cylindrical openings or pockets 40 therearound, and a cap 42 threadably secured to the part 38. The container 32 forms the reservoir 24 for the motor fluid.

Within the container 32 is a generally cylindrical member 44 having a flange 46 bolted to a flange member 48 which in turn is connected to the motor housing 20. The flange 46 and the flange 48 form an impeller chamber 50 in which is located the impeller 28. A sleeve 52 surrounds and is spaced from one part of the member 44; the remainder of the member 44 is spaced from the inner wall of the container part 38 except at the bottom where it is sealed by a ring 54 to the container part 38 thus forming a passageway 56 communicating at one end with the impeller chamber 50 and at the other with the pockets 40—the latter being open at their bottom ends and thus communicating with the reservoir 24.

A heat pipe 58 is received in each opening or pocket 40 with one end 60 extending therefrom such that the end 60 is exterior to the heat exchanger container 32. A sleeve 62 having exterior threads 64 surrounds the pipe 58 and is welded or otherwise connected thereto. A portion of each pocket 40 is threaded at 66 to receive the threads 64. The sleeves 62 support the heat pipes 58 so that they are spaced from the walls of the pockets 40, permitting motor fluid to flow therearound. In the positions shown, the ends 60 of the heat pipes 58 are in contact with well fluid when the assembly is lowered into a well casing 12, while the opposite ends 68 of the heat pipes are in contact with motor fluid in the reservoir 24.

Each of the heat pipes 58 is generally conventional in construction, being a sealed unit with walls of a capillary construction containing a volatile fluid which vaporizes at the hot end, i.e., that in contact with the motor fluid and which condenses at the cold end, i.e., that in contact with the well fluid.

What we claim is:

1. A submersible pump-motor combination especially adaptable for use in a well casing containing well fluid, the motor being located in a housing filled with motor lubricant fluid with a motor fluid reservoir adjacent to one end thereof the improvement comprising:

heat pipe means spaced from said motor with one end in said housing exposed to said motor fluid circulating from said motor to said reservoir and the other end outside said housing exposed to said well fluid, said heat pipe means containing a heat transfer fluid which absorbs heat from said motor fluid and transfers heat to said well fluid, and means for circulating said motor fluid from said motor around said one end of said heat pipe means to said reservoir.

2. A submersible pump-motor combination as recited in claim 1, further comprising impelling means driven by said motor and spaced from said heat pipe means for circulating said motor fluid.

3. A submersible pump-motor combination adaptable for use in a well casing containing well fluid and with the motor filled with motor lubricant fluid, comprising:

a housing for said motor;

a reservoir connected to said housing for motor lubricant;

heat pipe means having a portion exposed to said motor lubricant fluid and a portion exposed to well fluid, said heat pipe means containing a heat transfer which absorbs heat from said motor lubricant fluid and transfers heat to said well fluid; at least one elongated cylindrical pocket in said housing supporting a heat pipe means, said pocket having an open end communicating with said reservoir; and a passageway for the flow of motor lubricant fluid to said pocket, around said heat pipe means and into said reservoir.

4. A submersible pump-motor combination as recited in claim 3, further comprising impelling means driven by said motor for impelling motor lubricating fluid into said passageway.

* * * * *

UNITED STATES PATENT AND TRADEMARK OFFICE

CERTIFICATE OF CORRECTION

PATENT NO. : 4,685,867

DATED : August 11, 1987

INVENTOR(S) : RONALD JOSEPH PATUN and DONATAS TIJUNELIS

It is certified that error appears in the above-identified patent and that said Letters Patent is hereby corrected as shown below:

Column 4, line 2, before "to" insert -- and --.

Column 4, line 16, before "which" insert -- fluid --.

Signed and Sealed this

Twenty-fourth Day of November, 1987

*Attest:*

DONALD J. QUIGG

*Attesting Officer*

*Commissioner of Patents and Trademarks*